US007129407B2

(12) United States Patent
Hiratsuka et al.

(10) Patent No.: US 7,129,407 B2
(45) Date of Patent: Oct. 31, 2006

(54) APPARATUS AND COMPUTER PROGRAM FOR PRACTICING MUSICAL INSTRUMENT

(75) Inventors: Satoshi Hiratsuka, Hamamatsu (JP); Chieko Koga, Hamamatsu (JP)

(73) Assignee: Yamaha Corporation (JP)

( * ) Notice: Subject to any disclaimer, the term of this patent is extended or adjusted under 35 U.S.C. 154(b) by 157 days.

(21) Appl. No.: 10/787,534

(22) Filed: Feb. 26, 2004

(65) Prior Publication Data

US 2004/0221707 A1 Nov. 11, 2004

(30) Foreign Application Priority Data

Feb. 28, 2003 (JP) ..... 2003-052667

(51) Int. Cl.
*G10H 7/00* (2006.01)

(52) U.S. Cl. ..... 84/609; 84/477 R; 434/350

(58) Field of Classification Search ..... 84/609, 84/477 R, 649, 454, 470 R, 645, 616
See application file for complete search history.

(56) References Cited

U.S. PATENT DOCUMENTS 5,270,475 A 12/1993 Weiss et al.
5,495,786 A * 3/1996 Choi ..... 84/470 R
5,563,358 A 10/1996 Zimmerman
5,585,583 A * 12/1996 Owen ..... 84/470 R
5,902,948 A * 5/1999 Haruyama ..... 84/609
6,175,070 B1 1/2001 Naples et al.
6,287,124 B1 * 9/2001 Yamaura et al. ..... 434/219
6,323,411 B1 * 11/2001 Fukata ..... 84/477 R
6,346,666 B1 * 2/2002 Tsai et al. ..... 84/637
2002/0004191 A1 * 1/2002 Tice et al. ..... 434/350
2003/0167903 A1 * 9/2003 Funaki ..... 84/477 R

FOREIGN PATENT DOCUMENTS

EP 1 174 856 A2 6/2001
EP 1 465 150 A1 2/2004
JP 10-69273 A 3/1998

* cited by examiner

*Primary Examiner*—Marlon T. Fletcher
*Assistant Examiner*—Christina Russell
(74) *Attorney, Agent, or Firm*—Rossi, Kimms & McDowell, LLP

(57) ABSTRACT

A model music data inputting unit inputs model music data containing music score display data representing a music score to be displayed of a model music piece for practice, performance data representing a musical performance which coincides with the music score to be displayed, and performance data particularly prepared for playing back with musical emotions the tones of the model music piece for practice. When the practice mode is switched on, the display device displays a music score of the model music piece for practice, and the performance inputted by the user is compared with the performance data coinciding with the music score for evaluation. When the practice mode is switched off, the performance data particularly prepared for playing back the tones with musical emotions are supplied to the tone generator for playing back the tones.

2 Claims, 7 Drawing Sheets

Functional Configration

*Fig. 1* Functional Configration
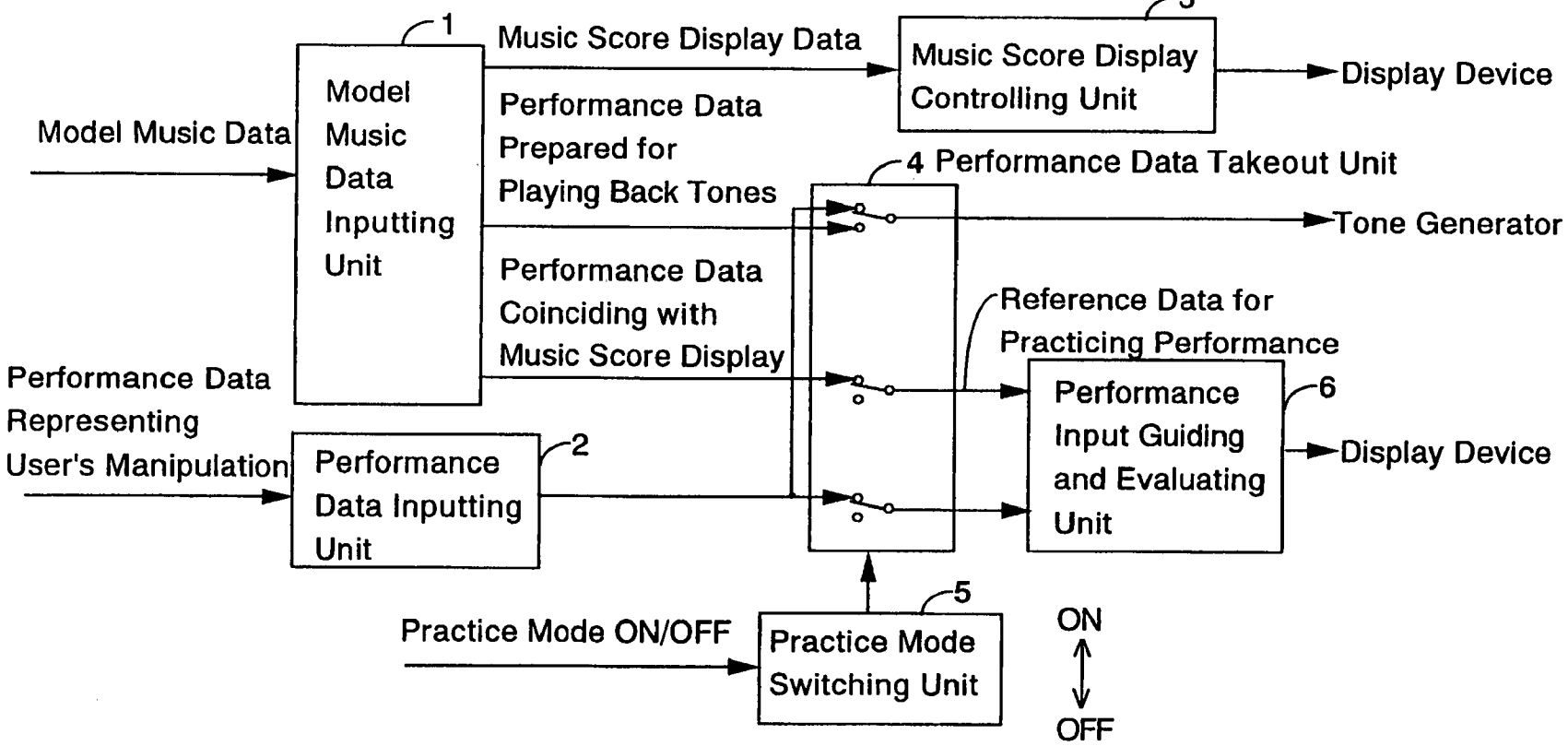

*Fig.2* Model Music Data Structure
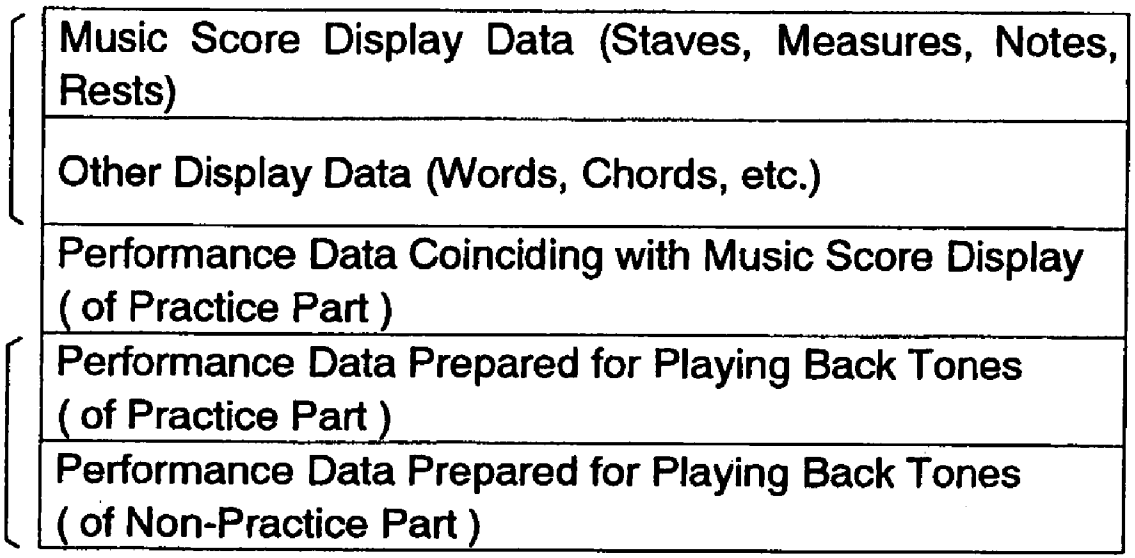

*Fig.3a* Performance Data List ( with Practice Mode Off )

| No. | Performance Data |
|---|---|
| 1 | Performance Data Prepared for Playing Back Tones of Practice Part #1 |
| 2 | Performance Data Prepared for Playing Back Tones of Practice Part #2 |
| 3 | Performance Data Prepared for Playing Back Tones of Part #a Other than Practice Parts |
| 4 | Performance Data Prepared for Playing Back Tones of Part #b Other than Practice Parts |
| 5 | Performance Data Prepared for Playing Back Tones of Part #c Other than Practice Parts |
| ... | ..... |

*Fig.3b* Performance Data List ( with Practice Mode On )

| No. | Performance Data |
|---|---|
| 1 | Performance Data Coinciding with Music Score Display of Practice Part #1 |
| 2 | Performance Data Coinciding with Music Score Display of Practice Part #2 |
| 3 | Performance Data Prepared for Playing Back Tones of Part #a Other than Practice Parts |
| 4 | Performance Data Prepared for Playing Back Tones of Part #b Other than Practice Parts |
| 5 | Performance Data Prepared for Playing Back Tones of Part #c Other than Practice Parts |
| ... | ..... |

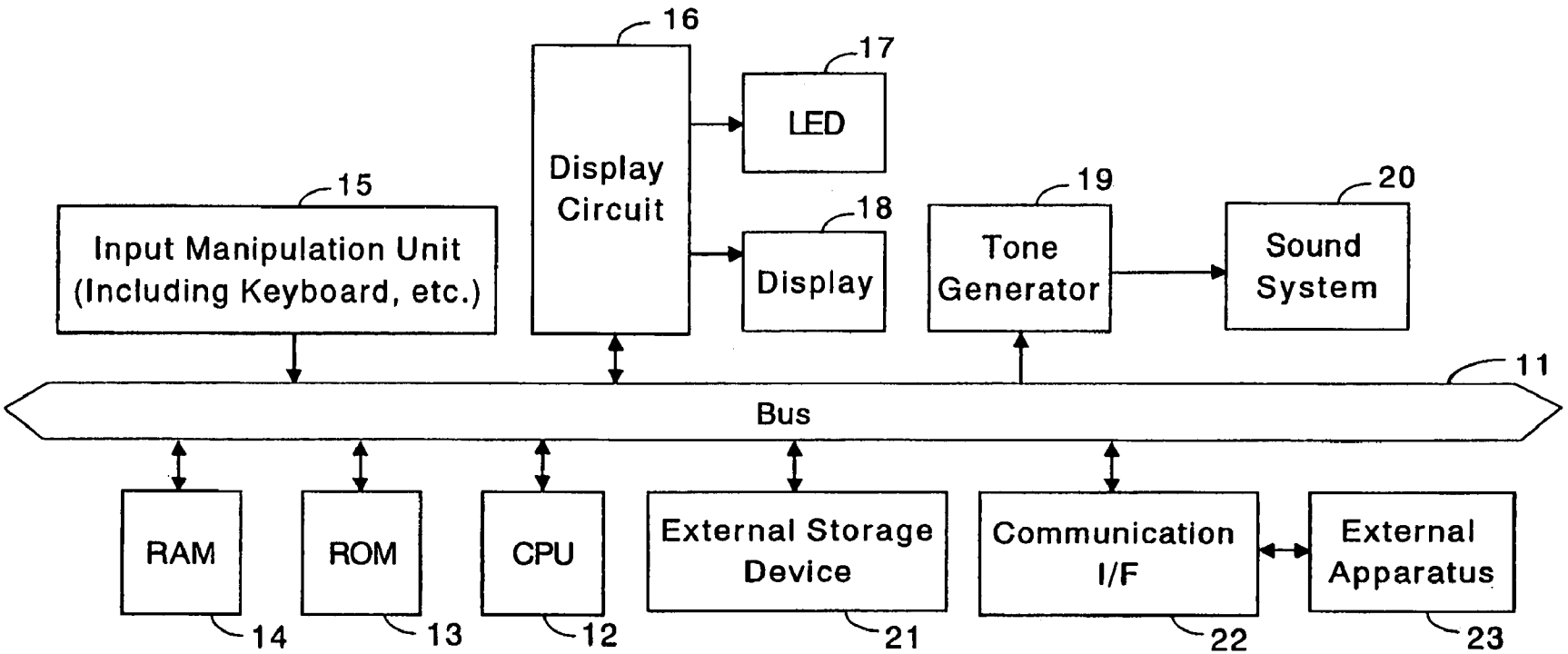
*Fig. 4* Hardware Configuration

*Fig. 5a* Processing Flow (Part 1)
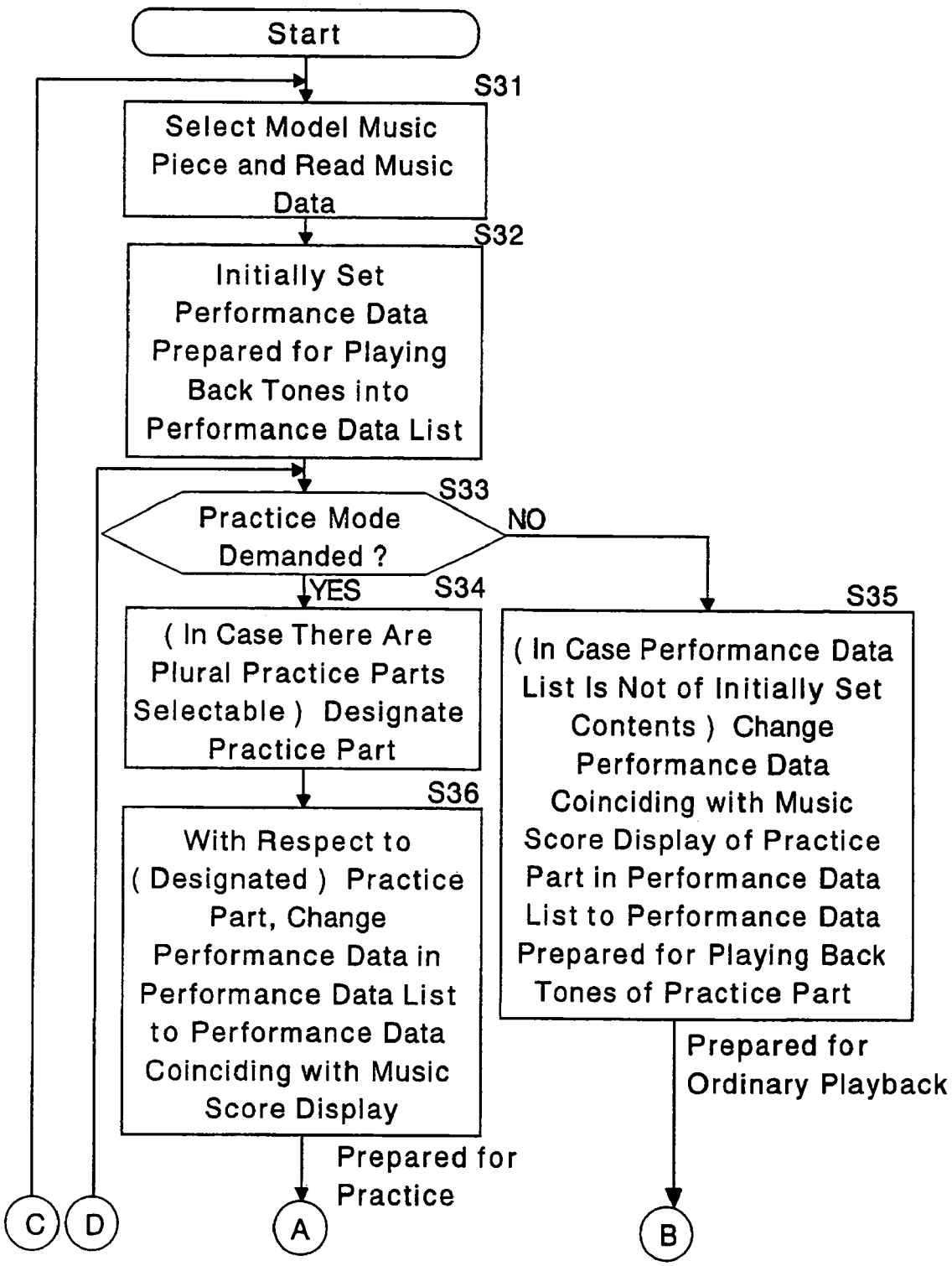

*Fig. 5b* Processing Flow (Part 2)
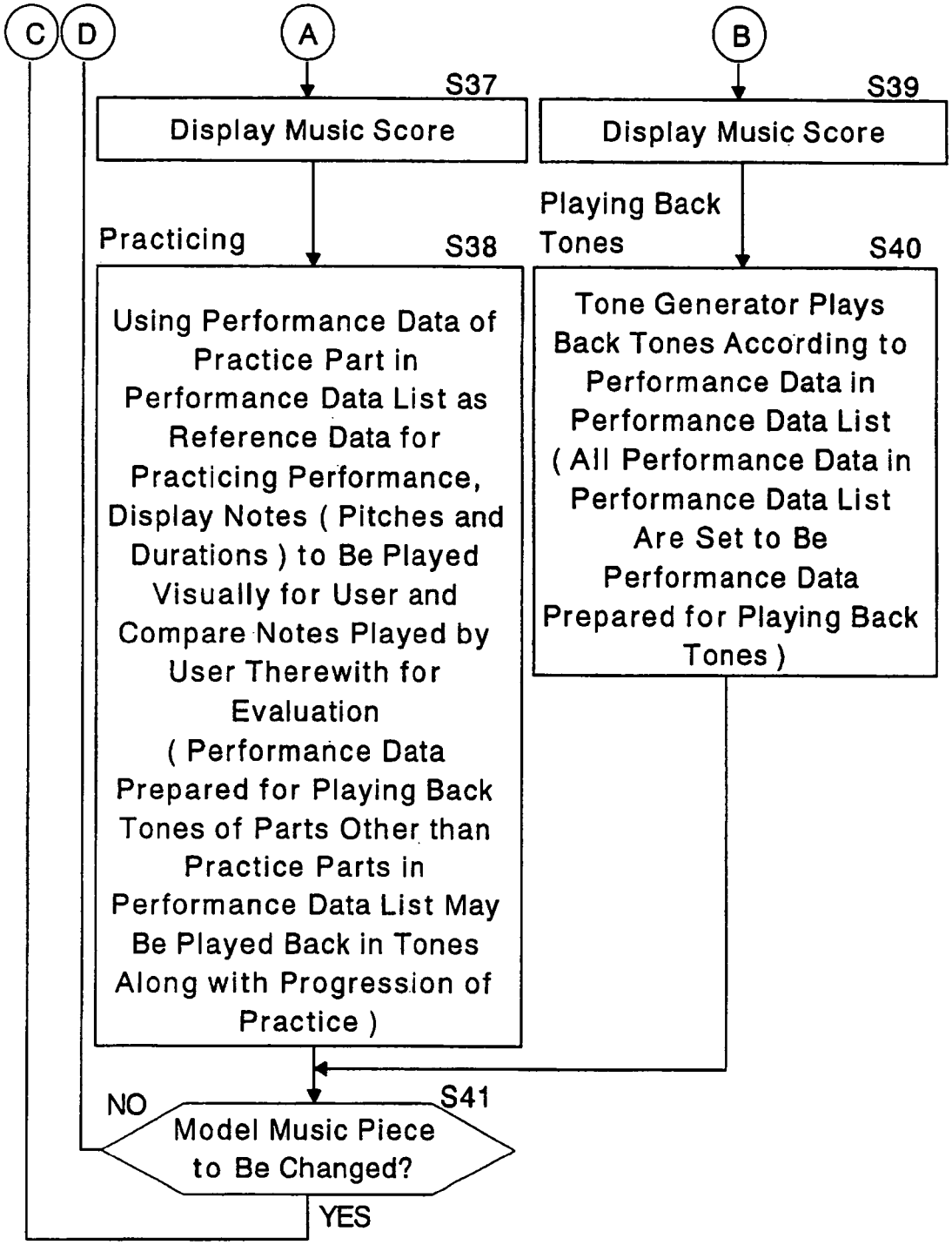

*Fig.6* (PRIOR ART) Relation between Note and Performance Data (in example Where Performance Data Prepared for Playing Back Tone Comes a Bit Earlier than Timing of Note as Displayed)
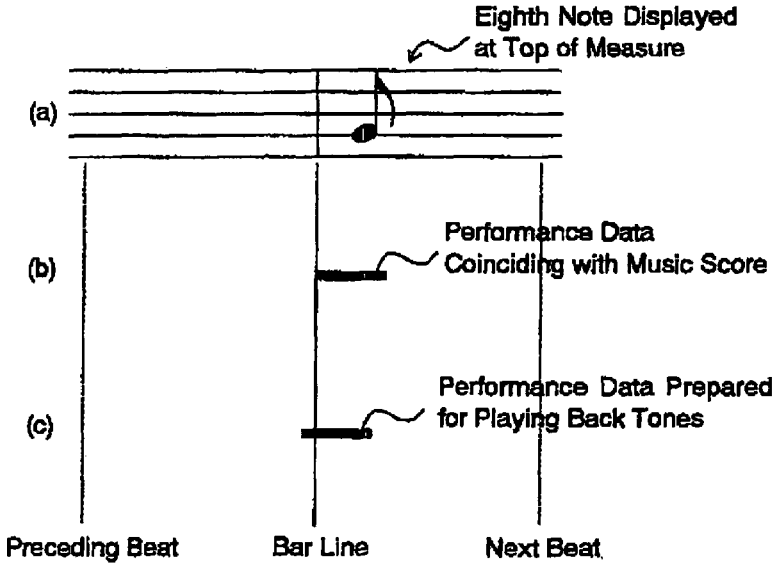

APPARATUS AND COMPUTER PROGRAM FOR PRACTICING MUSICAL INSTRUMENT

TECHNICAL FIELD

The present invention relates to an apparatus and a computer program for practicing musical instrument, and more particularly to an apparatus and a computer program for practicing musical instrument according to a model piece of music of which the music score is displayed on a screen and the musical performance is played back in tones, wherein a set of model music data contains music score display data, performance data for playing back tones and performance data which coincide with the music score display.

BACKGROUND INFORMATION

Known in the art is an electronic musical instrument which provides model pieces of music for a user to select a model piece of music and practice playing the selected piece on the musical instrument. The user is to practice the musical instrument by judging which notes to play according to the notes printed on a sheet music. The performance is (i.e. the played notes are) compared with the model music piece in data, and the result of the evaluation is to be shown on the display device of the electronic musical instrument.

In such a system, however, the model music data as the reference for comparison is performance data for playing back tones for an actual performance including musical expressions (i.e. emotions). The tone generation time points and durations of the respective notes may be different from the indicated notes on the music score to some extents, accordingly. Consequently, even though the user plays every note exactly in view of the music score, the played notes may not necessarily coincide with the notes in the model performance data so that the evaluation will not be very good sometimes.

There is another type of electronic musical instrument for practice, which provides guide lamps on the keyboard. The user is to follow the lighting guide lamps to know which notes to play for inputting performance data. But, as long as the model music data as the reference for comparison is the music data for playing back tones for performance as described above, a beginner will find difficulty in practicing performance according to such model music data as a reference for practice.

In this connection, the performance guide data may be separately composed by modifying the performance data which have been prepared particularly for playing back tones, or may be stored in a separate track exclusively provided for the playing guide, as known in the art, for example, as disclosed in unexamined Japanese patent publication No. H10-69732. However, the correspondence or concurrence between the guiding data and the music sheet notation is not taken care of precisely, the user will be perplexed as to which to follow, the guiding lamps or the printed notes on the sheet music.

Thus, there will be some inconveniences in practicing performance (i.e. musical instrument play) following the performance data prepared for playing back tones of the model music piece in either of the above cases.

FIG. 6 shows the relations between the printed notes on the sheet music and the performance data prepared for playing back tones. For example, in the case where there is an eighth note at the top of a measure on the music score as shown at part (a) of FIG. 6, the performance data corresponding to the music score notation should have a duration starting at the time point of the top of the measure and ending at the time point half way to the next beat to coincide with the position of the displayed note, as shown at part (b) of FIG. 6. In an actual performance, however, there may be a situation, as shown at part (c) of FIG. 6, where the starting time point of the note comes a bit earlier than the bar line (the top of the measure) with a musical emotion added at least to the starting time point of the note. In such a situation, there may arise an inconvenience that such a note at the top of the measure according to the music score may not be included among the played-back tones of the repetition span for practice, when the practice is repeated with respect to a span having such a measure at the top of the span.

As explained above, there may be various problems in practicing the instrument performance, where the model music data is the performance data prepared particularly for playing back the performance tones.

SUMMARY OF THE INVENTION

It is, therefore, a primary object of the present invention to solve the drawbacks with the conventional instruments, and to provide a novel type of apparatus and a computer program for practicing musical instrument, which provide adequate reference data for practicing musical instrument to be compared with the performance data inputted by the user.

According to the present invention, the object is accomplished by providing an apparatus for practicing musical instrument comprising: a model music data input device which inputs model music data containing music score display data representing a music score to be displayed of a model music piece for practice and performance data representing a musical performance which coincides with the music score to be displayed; a display device which displays the music score according to the music score display data, the display device further displaying a guidance for a user to input a performance of the model music piece for practice and displaying an evaluation of the performance by the user with respect to the displayed music score of the model music piece; a performance data inputting device which inputs performance data representing user's manipulation for a musical performance; a music score display controlling device which controls the display device to display the music score of the model music piece for practice according to the music score display data; and a performance data takeout device which takes out the performance data representing the musical performance of the model music piece for practice which coincides with the music score to be displayed as reference data for practicing performance to be used for the performance input guidance for the user and/or the evaluation of the user's performance.

Thus, the guidance for the user to input performance for practice and the evaluation of the user's performance will be made correctly in view of the music score of the model music for practice. As the performance reference data coincides with the music score data, the beginner will find it easy to grasp the times of the respective notes to play correctly. As the reference data coincide with the music score to be displayed, it will be convenient for practicing measure by measure or measures by measures the model music piece, with the top note in each note will always be included in the practice span. The user can easily set the span for the practice. As the display displays the music score of the model music piece according to the music score display data, the user can practice the instrument by watching the displayed music score on the screen. The display device may be included within the apparatus, or may be externally connected to the apparatus of the present invention.

According to the present invention, the object is further accomplished by providing an apparatus for practicing musical instrument comprising: a model music data input device which inputs model music data containing performance data representing a musical performance which coincides with a music score of a model music piece for practice, and performance data particularly prepared for playing back tones of the model music piece for practice; a tone generator which plays back tones according to performance data supplied thereto; a display device which displays a guidance for a user to input a performance of the model music piece for practice and displays an evaluation of the performance by the user with respect to the music score of the model music piece; a performance data inputting device which inputs performance data representing user's manipulation for a musical performance; a practice mode switching device which switches on and off a practice mode for the apparatus; and a performance data takeout device which, in case the practice mode is switched off by the practice mode switching device, takes out the performance data particularly prepared for playing back tones of the model music piece for practice to be supplied to the tone generator, and in case the practice mode is switched on by the practice mode switching device, takes out the performance data representing the musical performance which coincides with the music score of the model music piece for practice as reference data to be used for the performance input guidance for the user and/or the evaluation of the user's performance.

Under the practice mode, therefore, the guidance for the user to input performance for practice and the evaluation of the user's performance will be made correctly in view of the music score of the model music for practice. This is very convenient for the beginner, especially the user will practice playing the instrument with the model music piece on the measure-by-measure basis. This also facilitates the setting of a practice span. On the other hand, under the ordinary playback mode of the music (i.e. non-practice mode), the performance data particularly prepared for playing back tones are supplied to the tone generator, and a musical performance with full of musical emotions will be expected, without limited to a strict but rugged musical performance. The tone generator may be included within the apparatus of the present invention, or may be externally connected to the apparatus.

In an aspect of the present invention, the model music data contains music score display data representing a music score to be displayed of the model music piece for practice, and the apparatus further comprises a music score display controlling device which controls the display device to display the music score of the model music piece for practice according to the music score display data. The user can practice playing the musical instrument by watching a music score on the display screen in place of an ordinary sheet music printed on paper.

According to the present invention, the object is still further accomplished by providing a computer program containing program instructions executable by a computer for a user to practice musical instrument, the computer being connected to a display device, and the program causing the computer to execute: a model music data input step of inputting model music data containing music score display data representing a music score to be displayed of a model music piece for practice and performance data representing a musical performance which coincides with the music score to be displayed; a performance data input step of inputting performance data representing user's manipulation for a musical performance; a music score display control step of controlling the display device to display the music score of the model music piece for practice according to the music score display data; and a performance data takeout step of taking out the performance data representing the musical performance of the model music piece for practice which coincides with the music score to be displayed as reference data for practicing performance to be used for a performance input guidance for the user and/or an evaluation of the user's performance.

According to the present invention, the object is still further accomplished by providing a computer program containing program instructions executable by a computer for a user to practice musical instrument, the computer being connected to a tone generator and to a display device, and the program causing the computer to execute: a model music data input step of inputting model music data containing performance data representing a musical performance which coincides with a music score of a model music piece for practice, and performance data particularly prepared for playing back tones of the model music piece for practice; a performance data input step of inputting performance data representing user's manipulation for a musical performance; a practice mode switching step of switching on and off a practice mode for the apparatus; and a performance data takeout step of, in case the practice mode is switched off by the practice mode switching device, taking out the performance data particularly prepared for playing back tones of the model music piece for practice to be supplied to the tone generator, and in case the practice mode is switched on by the practice mode switching device, taking out the performance data representing the musical performance which coincides with the music score of the model music piece for practice as reference data to be supplied to the display device for a performance input guidance for the user and/or an evaluation of the user's performance.

The computer and the associated program will provide flexibility in configuring the apparatus. Some of the hardware structured discrete module may be configured by a computer system and the associated program to perform the same function. Therefore, a hardware-structured device performing a certain function and a computer-configured arrangement performing the same function should be considered a same-named device or an equivalent to each other.

BRIEF DESCRIPTION OF THE DRAWINGS

For a better understanding of the present invention, and to show how the same may be practiced and will work, reference will now be made, by way of example, to the accompanying drawings, in which:

FIG. 1 is a block diagram illustrating the functional configuration of an embodiment of an apparatus for practicing musical instrument according to the present invention;

FIG. 2 is a chart showing an example of the structure of model music data as included in FIG. 1;

FIG. 3*a* is a chart showing an example of performance data list under the off condition of the practice mode to explain the function of the performance data takeout unit of FIG. 1;

FIG. 3*b* is a chart showing an example of performance data list under the on condition of the practice mode to explain the function of the performance data takeout unit of FIG. 1;

FIG. 4 is a block diagram illustrating the hardware configuration of an embodiment of an apparatus for practicing musical instrument which performs the function of the present invention as shown in FIG. 1;

FIGS. 5*a* and 5*b*, in combination, are a flow chart describing the process steps performed by the apparatus shown in FIG. 1; and FIG. 6 is a chart explaining an example of the relation between a note and performance data as may happen in connection with practicing the musical instrument performance.

DETAILED DESCRIPTION OF EMBODIMENTS OF THE INVENTION

FIG. 1 shows a block diagram illustrating the functional configuration of an embodiment of an apparatus for practicing musical instrument according to the present invention. As shown in FIG. 1, the apparatus for practicing musical instrument comprises a model music data inputting unit 1, a performance data inputting unit 2, a music score display controlling unit 3, a performance data takeout unit 4, a practice mode switching unit 5 and a performance input guiding and evaluating unit 6. The model music data inputting unit 1 is to input model music data containing music score display data, performance data prepared particularly for playing back tones for the music piece to be performed, and performance data which coincide with the music score to be displayed. The performance data inputting unit 2 is to input performance data which represent the user's manipulation of a input manipulation unit such as a keyboard for playing the musical instrument. The music score display controlling unit 3 is to control a display device to display a music score according to the music score display data contained in the model music data which are inputted at the model music data inputting unit 1. The performance data takeout unit 4 is to switch over which data to be sent to which unit or device. The depicted switches represent the function of this unit 4. When the practice mode is "on," The unit 4 takes out the performance data which coincide with the music score display as contained in the model music data inputted by the model music data inputting unit 1 to send to the performance input guiding and evaluating unit 6 as reference data for practicing performance to be used for guiding the user to input his or her performance from the performance data inputting unit 2 and for evaluating the inputted user's performance.

The performance input guiding and evaluating unit 6 determines for the user the information about the notes to be performed (or played) such as pitches, starting time points and durations of the respective notes in accordance with the reference data for practicing performance, when the practice mode is "on." The determined note information about the respective notes to be performed is displayed on a display device. The display device also displays the evaluation result of the user's performance input in reference to the information about the notes to be performed.

In the case of guiding the user for performance input (e.g. keyboard manipulation), for example, the apparatus indicates to the user which note to play just before the required timing of manipulation of every note by flashing the guide lamp or by exhibiting guidance on the display screen. In the case of evaluating the inputted user's performance, for example, the apparatus evaluates the inputted performance data of the user's manipulation as outputted from the performance data takeout unit 4 by comparing the same with the reference data for practicing performance. For example, the evaluation is conducted as to whether and how much the start time of the note in the user's performance data is different from that in the reference data for practicing performance, and the evaluation result will be displayed on the display device. The performance data of the user's manipulation may be outputted to a tone generator and in turn to a sound system (not shown) to produces tone signals and sounds of the music performance.

On the other hand, in the case where the practice mode is set to "off" mode, the performance data takeout unit 4 does not drive the tone generator with the reference data for practicing performance, as the reference data is accurate in view of the musical notation of the performance but may be musically emotionless. Instead, the performance data takeout unit 4 outputs to the tone generator the performance data prepared for playing back tones contained in the model music data as inputted from the model music data inputting unit 1. The practice mode switching unit 5 is to control the on/off conditions of the practice mode in the above mentioned performance data takeout unit 4.

FIG. 2 shows an example of the structure of model music data as included in FIG. 1 above. The model music data are stored, for example, in plural tracks so that plural kinds of data can be individually extracted for individual use. The data file of the musical data for display consists of music score display data and other display data. The music score display data are data for depicting signs and symbols for a musical performance such as staves, measure lines, notes rests, and include data defining the colors, sizes, directions (for example, the direction of the stem with respect to the head), etc. of the fonts of the musical signs and symbols, and the coordinates for locating the respective sign/symbol fonts. The other display data are data for exhibiting other items not directly concerning the performance such as words, chords, guitar tablatures, etc. and include data defining the colors, sizes, directions, etc. of the fonts of such indications and the coordinates for locating such fonts. The above mentioned musical data for display can be derived from the music score display data of high quality as used conventionally in the music score display data file for displaying a music score on a display screen or for printing a music score on a sheet of paper.

The reference data to be used for practicing performance is the performance data which coincides with the music score display, and is defined in other words as the performance data representing a musical performance which is a faithful substantiation of the music score in the form of a progression of tones (i.e. a musical performance obtained when the player plays the music faithfully according to the music score).

As explained before with reference to FIG. 6, the time of each tone coincides with the position of each corresponding note on the music score and the intensities (sometimes called "velocities" in the field of electronic musical apparatus) of the tones are uniform. Thus, the tone generations will start at times on the beats in a measure. The performance data which coincides with the music score display may be composed as performance data which conforms the MIDI protocol. The performance data which coincides with the music score display may contain a plurality of data sets separately for a plurality of performance parts to be practiced individually, for example, for a melody part, an accompaniment part, a right hand part, a left hand part, and so forth. Such a plurality of parts may be used for the performance input guiding or for the performance evaluation on a one-part-by-one-part basis or with plural parts concurrently for the user to practice playing the model music piece. The subject part or parts for practice will preferably be displayed in the form of a music score on a display device according to the music score display data, but may be printed in the form of a sheet music (on paper) for the user to input his or her performance.

On the other hand, the data sub-file of the performance data for playing tones of a musical performance consists performance data prepared particularly for playing back tones of the practice part (or parts) and performance data prepared particularly for playing back tones of the non-practicing part (or parts). The performance data prepared for playing back tones of the practice part are data which are suitable for playing back musical tones of the part corresponding to the practice part, and include note data representing notes of which at least starting times are emotionally modified from a musical point of view. Modifications may further be made with respect to the note durations and the tone intensities. The performance data prepared for playing back tones of the parts other than the practice parts are data which are prepared for playing back musical tones of the parts other than the above mentioned practice parts. Such other parts include a rhythm part (percussion part), a pedal keyboard part, etc. The performance data which are particularly prepared for playing back tones may also be composed as performance data which conforms the MIDI protocol.

In the example shown in FIG. 2, the model music data file has a data-contents structure including the musical data for display, the reference data for practicing performance and the performance data for playing back tones. Instead, the model music data may be composed in a two-file structure consisting of a first data file of the musical data for display plus the reference data for practicing performance and a second data file of the data for playing back tones, or a two-file structure consisting of a first data file of the musical data for display and a second data file of the reference data for practicing performance plus the performance data prepared for playing back tones.

The above described performance data which coincide with the music score display may contain limited kinds of fundamental data of performance such as types and pitches of the respective notes, while other necessary data such as to define coordinate positions of the notes may be supplemented by the music score display data. The performance data prepared for playing back tones of the practice part may be expressed in the form of the differential data in reference to the performance data which coincides with the music score display of the same practice part, representing the differences of the starting time and the duration of each note.

FIGS. 3*a* and 3*b* show examples of the performance data lists to explain the function of the performance data takeout unit of FIG. 1, under the "off" condition and the "on" condition, respectively, of the practice mode. The performance data lists are used to administer the performance data on the respective data tracks of the model music stored in the memory. The figures show those for five tracks each. The performance data list is to register the data of which tracks of the model music data are to be sent to which of the tone generator and the performance input guiding and evaluating unit 6. The performance data takeout unit 4 takes out the performance data based on the contents of the performance data list. Different contents are registered in the performance data list for the "off" condition and for the "on" condition of the practice mode.

For the "off" condition of the practice mode, the performance data prepared for playing back tones of the practice part #1 and the performance data prepared for playing back tones of the practice part #2 are registered in the channels #1 and #2, respectively, of the performance data list as shown in FIG. 3*a*. Specific examples may be the right hand performance data and the left hand performance data. In the channels #3 through #5, the performance data prepared for playing back tones of part #a through #c. For the "on" condition of the practice mode, the performance data which coincides with the music score display of the practice part #1 and the performance data which coincides with the music score display of the practice part #2 are registered in the channels #1 and #2, respectively. The contents of the channels #3 through #5 are not changed.

Although the performance data takeout unit 4 is shown with respect to the practice part in FIG. 1, it sends out all of the performance data in the channels #1 through #5 to the tone generator. Under the practice mode "on," it sends out the performance data in the channels #1 and #2 to the performance input guiding and evaluating unit 6 and the performance data in the channels #3 through #5 to the tone generator. While the above mentioned performance data lists are assumed to have the performance data of a piece of music registered in its entirety, the registration conditions may be partly different for the portions of the music to be practiced and for the remaining portions, so that the user can practice some of the measures or some of the phrases of the music piece. In the above explanation, the performance data list contains the names of the performance data correspondingly allotted to the channels to show the registration conditions. As a matter of practice, the registration contents may be the pointers or the head addresses of the data which indicate the locations of the data in the memory when the model music data is loaded into the memory. Alternatively, data themselves of the respective tracks may be loaded into the memory regions as designated by the respective channels, or the model music data themselves as loaded into the memory by the model music data inputting unit 1 may be rearranged to effect registration of the performance data list.

FIG. 4 shows a block diagram illustrating the hardware configuration of an embodiment of an apparatus for practicing musical instrument which performs the function of the present invention as shown in FIG. 1. Herein below will be described an embodiment in which the present invention is realized for practicing musical instrument by executing a computer program on an electronic musical system such as an electronic musical instrument.

To the system bus 11 are connected a CPU (central processing unit), a ROM (read only memory), a RAM (random access memory), and so forth. The RAM 14 provides working areas for the CPU 12, and the ROM 13 stores control programs for operating the CPU 12 and various preset data.

An input manipulation unit 15 is connected to the system for the user to input manipulations for playing music and controlling the system, including a keyboard and various controls (such as switches and adjusters). The keyboard outputs performance data containing data on key depression times, key numbers (note pitches), key release times, etc. The various controls include switches and adjusters for controlling the functions of the performance practice on model music data and for setting various parameters for the system operation. The model music data shown in FIG. 2 are stored in the ROM 13 or in an external storage device 21, and will be reloaded in to the RAM 14 for an actual use.

A display circuit 16 is also connected to the system to drive LED's 17 and a display device 18, and outputs flashing signals to the light emitting diodes 17 arranged on or in the vicinity of the keyboard and image data to the display device 18 such as a liquid crystal panel. The display screen 18 displays a music score and an evaluation report about the inputted performance by the user as well. A tone generator 19 and a sound system 20 are for producing musical tones based on the performance data. The tone generator 19 receives tone generation controlling parameters according to the performance data, synthesize the musical tone signals, and outputs the same to the sound system 20 so that audible sounds are emitted from a loudspeaker. The tone generator 19 may be configured by dedicated hardware or by a DSP (digital signal processor) plus a micro program therefor. Alternatively, the CPU 12 may take the role of synthesizing tone waveforms to act as a software tone generator in association with a software tone generation program.

An external storage device 21 is also connected to the system to supplement storage of the data files necessary for operating the system for practicing musical instrument play. The external storage device 21 may be a flash memory, an FDD (flexible disk drive), an HDD (hard disk drive), a CD-ROM (compact disc read only memory) drive, an MO (magneto-optical disk) drive, a DVD (digital versatile disk) drive, and so forth. The control programs may be stored in a hard disk, and can be transferred to the RAM 14 upon use. A communication interface 22 is also connected to the system to prepare for the connection of the system bus 11 to external apparatuses 23 such as an external tone source or generator and a separate MIDI keyboard. The communication interface 22 may not necessarily be a dedicated MIDI interface, but may be a general-purpose interface to be connected to an external or remote apparatus such as a personal computer, a server, etc. via a direct cable, a LAN (local area network), Internet or else. Model music data files in an external apparatus 23 can be downloaded to the external storage device 21, and also can be supplied to the RAM 14 for a real-time playback or a streaming playback of the music.

The CPU 12 reads out from the ROM 13 a control program for the electronic musical system including a program for practicing musical performance (i.e. musical instrument play) and load the same into the RAM 14 for various controls. With reference to the performance data list of FIG. 3 loaded in the RAM 14, the CPU 12 creates tone generator controlling parameters including note-on times, note-off times, note pitches, tone colors, etc. according to the performance data prepared for playing back tones of the respective tracks, and outputs the same to the tone generator 19. Concurrently, the CPU 12 reads out the musical fonts such as musical staves, bar lines and notes and creates image data for a music score, and outputs the same to the display circuit 16. The CPU 12 further outputs data for guiding musical performance input and the results of evaluation of the user's performance input to the display circuit 16 which in turn drives the LED indicators 17 and the display panel 18. The similar operation and function for practicing musical instrument play can be realized by a personal computer associated with this system. The keyboard, the mouse and other controls can be used as the input manipulation unit 15, and a MIDI keyboard can be used as the music playing keyboard when connected via the communication interface 22 as an external apparatus 23.

FIGS. 5*a* and 5*b*, in combination, show a flow chart describing the process steps operated by the apparatus shown in FIG. 1. At a step S31 (see FIG. 5*a*), the user decides a model music piece to be used for practice, and the system reads the data of the decided model music piece from the external storage device 21 or from the external apparatus 23 to store into the RAM 14. Then, a step S32 initially sets the performance data which are particularly prepared for playing back tones of the music into the performance data list shown in FIG. 3*a*. A step S33 judges whether the practice mode is demanded by the user. The conditions for entering the practice mode will be determined by the manipulations of the controls on the panel of the electronic musical apparatus, the button clicking on the display screen, or by automatic selection according to the set menu. For example, model music data contain an indication flag for each practice music piece to tell that the selected music piece is a model music piece for practice so that the system (i.e. the CPU 12) detects the indication flag in the read-out model music piece to judge that the practice mode is demanded. If the judgment at the step S34 is affirmative (YES), the process flow moves forward to a step S34, while if the judgment is negative (NO), the process goes to a step S35. The step S34 is for the case where there are plural practice parts and they are selectable, and the user can designate a practice part according to his or her choice. If there are no plural selectable practice parts, the process flow skips to the next step S36.

The step S34 designates a practice part or parts, and the step S36 changes the performance data of the designated part or parts in the performance data list to the performance data which coincide with the music score display. Thus the system is prepared for practice, and a step S37 (see FIG. 5*b*) displays the music score of the model music piece for practice on the display screen 18. The user now conducts practice at a step S38, watching the displayed music score. During the practice, the performance data derived from the user's performance input are outputted to the tone generator 19 to play back the user's performance in audible musical tones. On such an occasion, it will be very helpful to the user, if a cursor is displayed on the screen and follows the progression of the music playback on the music score.

FIG. 3*b* shows a performance data list employed when the practice mode is turned "on," in which the first and the second channel are substituted by performance data which coincide with the music score display, and will be used as the reference data for practicing performance and will visually guide the user in inputting performance telling which key to depress and release at which time by flashing the light emitting diodes 17 arranged on the keyboard. The guidance may be done by moving a cursor on the music score, altering the colors of the progressing notes in the music score, and so forth. The evaluation will be given by comparing the performance data inputted by the user playing the model music on the system and the reference data for practicing performance, and displaying judgments about correct and incorrect plays (manipulations) or displaying the point (mark) of evaluation on the display screen. The evaluation may be reported instantaneously, or from time to time, or at the end of the performance of the model music piece for practice. Both the performance input guidance and the evaluation may preferably be presented, but either of the two may be helpful to the user.

When the practice with a model music piece is over, the process goes forward to a step S41 to ask the user whether he or she will continue further practice with the same model music piece or another one. During the user's practice, the performance data of the parts #a–#C in the channel Nos. 3–5 other than the practice parts #1 and #2 of the performance data list (FIG. 3*b*) may be outputted to the tone generator (tone generator 19 of FIG. 4) to play back the musical tones for performance along with the progression of the practice.

On the other hand, if the practice mode is not demanded, the process flow proceeds to the step S35. If the performance data list is of the initially set contents as shown in FIG. 3*a*, the step S35 does nothing and the process flow proceeds further to a step S39 (FIG. 5*b*). However, in case the performance data list is not of the initially set contents but of the contents as shown in FIG. 3*b*, the step S35 changes the performance data in the channels #1 and #2 (i.e. the performance data which coincide with the music score display of the practice parts) of the performance data list to the performance data particularly prepared for playing back tones for performance of the practice parts as shown in FIG. 3*a*. Thus, the process is now ready for the ordinary playback, and the step S39 displays the music score similarly to the step S37.

A step S40 is for playing back tones of the musical performance of the selected model music piece. The step S40 outputs to the tone generator the performance data prepared for playing back tones as now included in the performance data list shown in FIG. 3*a* also for the practice parts #1 and #2 in the channel Nos. 1 and 2. The user can now listen to the musical performance of high quality according to the performance data provided with full of musical emotions. The music score display may preferably contain a cursor which points at the progressing position of the music in the score. When the playback of the music piece is over, the process moves forward to the step S41. The step S41 judges whether the user wants to change the model music piece, and if so, the process goes back to the step S31 for new selection of the model music piece, and if not, the process goes back to the step S33.

In the above described embodiment, the model music pieces are selectable by the user. A model music piece may be automatically selected by the default processing. For example, when the user decides to start practice, the system presents a predetermined piece of music for the practice, and the process goes to the step S33. If the user would go forward to practicing, the process flows to the step S34 and forward and the performance input guidance and the performance evaluation will take place. If the user would first listen to the model performance, the process will flow to the step S35. While the performance data prepared for playing back tones are played back for all of the performance parts other than the practice parts under the practice mode in the above described embodiment, any or all of such parts other than the practice parts may be on/off controlled or set by the user for the tone playback. Further, the model music data may not necessarily contain performance data of the parts other than the practice parts inherently.

Further in the above described embodiment, when the performance input guidance and the performance evaluation take place, the performance data of the practice parts will not be outputted to the tone generator, but the performance data of the practice parts may be outputted to the tone generator and the tones may be played back in a reduced tone volume. Further in the above described embodiment, when the performance input guidance and the performance evaluation will not take place, the performance data prepared for playing back tones are supplied to the tone generator. However, the performance data which coincide with the music score display may be supplied to the tone generator with respect to the practice parts, so that the user will recognize how the performance would be, if the tones are played back strictly according to the notations in the music score.

In the above described embodiment, there is provided one kind of performance data which coincide with the music score display. But such data may be provided in several patterns for different grades of performance skill so that the user can select the type which meets the performance skill of the user. The display of the music score may not necessarily be varied according to the skill. The steps S37 and S39 are supposed to display the entire music score of the music piece at a time on the display 18, but the flow chart may be modified to display a necessary amount of the music score at a time and progressively switch over to the succeeding ones according to the performance progression. The amount of display at a time may be in the unit of page or measure (page by page or pages by pages, or measure by measure or measures by measures). Under the playback mode (i.e. not the practice mode), the display of the music score will be moved forward in synchronism with the playback of the music piece. Under the practice mode, on the other hand, the display of the music score will be moved forward as synchronized with the actual performance of the user. The playback of the music piece may be suspended until the user plays the correct note. The manner of the music score display may be made selectable by the user.

While the above description is about the embodiment of the invention as applied to a dedicated electronic musical apparatus, the system may be otherwise practiced by a personal computer having a tone generator module or board or a software tone generator program installed, or by a personal computer to which an external apparatus having tone generating functions is connected. The invention may be applicable to a PDA (personal digital assistant) device or other electric or electronic appliances such as a dedicated game machine and a cellular phone terminal for competing in the performance inputting skills.

As will be apparent from the descriptions heretofore, the invention provides performance data which coincide with the music score display as the reference data for practicing performance to be used for the performance input guidance and the performance evaluation, which means the invention provides a very suitable reference of performance.

While particular embodiments of the invention and particular modifications have been described, it will, of course, be understood by those skilled in the art that various modifications and substitutions may be made without departing from the spirit of the present invention so that the invention is not limited thereto, since further modifications may be made by those skilled in the art, particularly in light of the foregoing teachings. It is therefore contemplated by the appended claims to cover any such modifications that incorporate those features of these improvements in the true spirit and scope of the invention.

What is claimed is:

1. An apparatus for practicing a musical instrument, comprising:

a model music data input device which inputs model music data containing performance data representing a musical performance which coincides with a music score of a model music piece for practice, performance data prepared for playing back tones of said model music piece for practice, and a music score of said model music piece for practice to be displayed;

a tone generator which plays back tones according to performance data supplied thereto;

a display device;

a display controlling device which controls said display device to display said music score of said model music piece for practice according to said music score display data and to display at least one of a guidance for inputting a performance of said model music piece for practice by the user or an evaluation of the performance by the user with respect to said music score of said model music piece;

a performance data inputting device which inputs performance data representing user's manipulation for a musical performance;

a performance data takeout device; and a practice mode switching device which switches on and off the performance data takeout device, wherein when said practice mode switching device switches off said performance data takeout device, said performance data takeout device takes out said performance data prepared for playing back tones of said model music piece for practicing, to be supplied to said tone generator, and wherein when said practice mode switching device switches on said performance data takeout device, said performance data takeout device takes out said performance data representing the musical performance which coincides with said music score of said model music piece for at least one of practice as reference data for said performance input guidance for the user or said evaluation of the user's performance.

2. A computer-readable storing device storing a computer program for practicing a musical instrument, said program including instructions for:

inputting model music data containing performance data representing a musical performance which coincides with a music score of a model music piece for practice, performance data prepared for playing back tones of said model music piece for practice, and a music score to be displayed for practice;

controlling a display device to display said music score of said model music piece for practice according to said music score display data and to display at least one of a guidance for inputting a performance of said model music piece for practice by the user or an evaluation of the performance by the user with respect to the music score of said model music piece;

inputting performance data representing user's manipulation for a musical performance;

switching on and off a practice mode;

taking out said performance data prepared for playing back tones of said model music piece for practice to be supplied to a tone generator when the practice mode is switched off, and taking out said performance data representing said musical performance which coincides with said music score of said model music piece for at least one of practice as reference data to be supplied to said display device for a performance input guidance for the user or an evaluation of the user's performance when the practice mode is switched on.

* * * * *